United States Patent [19]

Tada et al.

[11] 4,046,154

[45] Sept. 6, 1977

[54] APPARATUS FOR CONTINUOUSLY REMOVING FILM COATING MATERIALS FROM FILM

[75] Inventors: Sugihiko Tada; Setsuo Nakai; Kazuo Irie; Hirokazu Saito; Hideaki Suzuki, all of Minami-ashigara, Japan

[73] Assignee: Fuji Photo Film Co., Ltd., Minami-ashigara, Japan

[21] Appl. No.: 654,829

[22] Filed: Feb. 3, 1976

Related U.S. Application Data

[63] Continuation of Ser. No. 450,516, March 12, 1974, abandoned.

[30] Foreign Application Priority Data

Mar. 12, 1973 Japan ..... 48-28707

[51] Int. Cl.[2] ..... B08B 3/08

[52] U.S. Cl. ..... 134/65; 134/109; 23/270 R

[58] Field of Search ..... 134/65, 109, 132-134, 134/25 R; 23/270 R

[56] References Cited

U.S. PATENT DOCUMENTS

| | | | |
|---|---|---|---|
| 2,086,181 | 7/1937 | Bonotto | 134/65 X |
| 2,191,255 | 2/1940 | Bonotto | 134/65 X |
| 2,196,594 | 4/1940 | Muskat | 23/270 R X |

FOREIGN PATENT DOCUMENTS

| | | | |
|---|---|---|---|
| 581,599 | 9/1958 | Italy | 134/65 |

*Primary Examiner*—Robert L. Bleutge
*Attorney, Agent, or Firm*—Sughrue, Rothwell, Mion, Zinn and Macpeak

[57] ABSTRACT

Apparatus for continuously removing a film coating material from a photosensitive base comprising continuously removing a photosensitive emulsion from a film base, which is coated with an emulsion, by the contact reaction of a removing liquid with the emulsion, continuously and automatically washing and recovering the emulsion-removed film base, and continuously and automatically concentrating and recovering the silver halide which is contained; also, in the suspension.

2 Claims, 4 Drawing Figures

FIG. 2
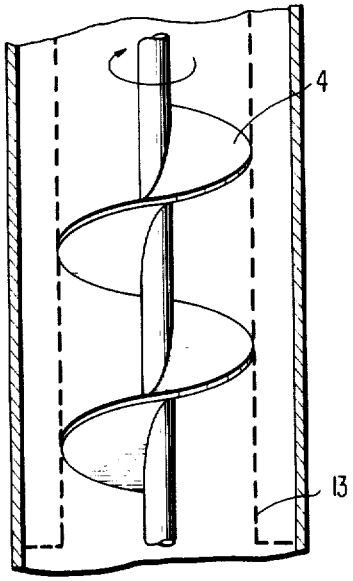
FIG. 3
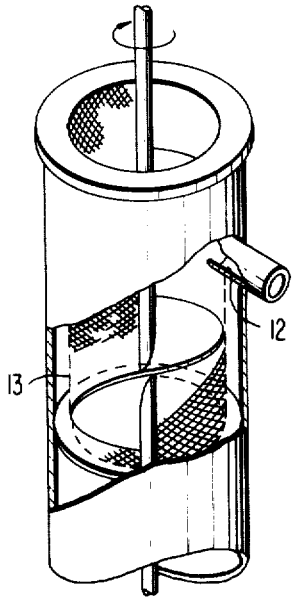
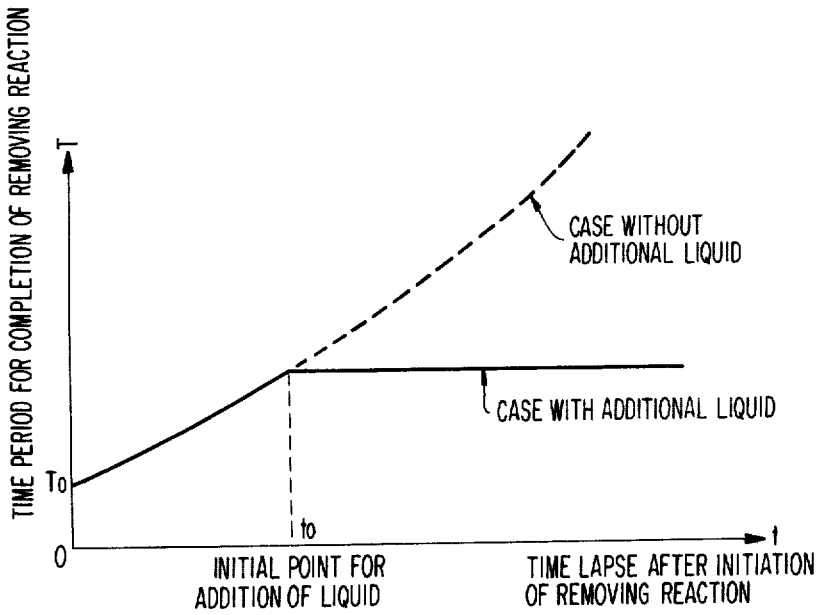
FIG. 4

APPARATUS FOR CONTINUOUSLY REMOVING FILM COATING MATERIALS FROM FILM

This is a continuation of application Ser. No. 450,516, filed Mar. 12, 1974, now abandoned.

BACKGROUND OF THE INVENTION

1. Field of the Invention

The present invention relates to apparatus for removing a film coating material from a photosensitive film support. More particularly, the present invention relates to apparatus for continuously removing a photosensitive emulsion from a film support, by contacting a removing liquid with the emulsion, continuously and automatically washing and recovering the emulsion-removed film support, and continuously and automatically concentrating and recovering the silver halide which is suspended in the emulsion.

2. Description of the Prior Art

In the conventional method for removing an emulsion layer from a film support, the film support is at first cut into thin chips. These chips are then introduced into an emulsion layer-removing bath, to which an emulsion layer-removing liquid is added. The chips and the liquid are then stirred and brought into contact with each other. As a result, the emulsion layers on the film chips are removed, and the chips thus treated are then subjected to a washing treatment several times in the presence of fresh water after the removing liquid has been discharged from the bath.

However, the following drawbacks exist in this conventional method:

1. Since the method is a batch process, it is laborious and time consuming, thus uneconomical;

2. When the method is intended to handle a large amount of film, equipment of an unnecessarily large scale is required so that difficulties arise in the space distribution and arrangement of the equipment, because of the batch processing;

3. Since the film chips always have a flake shape, they tend to stick to each other, so that the adhered surfaces do not contact the layer-removing liquid, thus some portions of the emulsion layers fail to be removed;

4. In view of item (3) above, when it is intended to provide sufficient contact between the film chips and the removing liquid, it is necessary to sufficiently disperse the former in the latter and to hold the liquid at a sufficiently high concentration for the removing reaction, a large amount of the liquid is necessarily consumed rendering the method uneconomical;

5. When the film chips are removed from the removing bath after the layer-removing process, they tend to stick to the wall of the bath, which in turn makes the removal step difficult and requires unnecessary labor and thus is not economical;

6. Since the coating material remaining should be recovered from the washing water which has been used for the purpose, it is difficult to continuously feed the necessary washing water, and the washing operation has to be stopped every time so as to remove the excess amount of water or to add water used, thus not only being laborsome but also being time consuming and uneconomical;

7. Since it is difficult to accomplish the continuous feed of the washing water, the subsequent washing process inevitably is a batch type process, so that the washing step cannot be carried out under some operating conditions.

SUMMARY OF THE INVENTION

It is, therefore, an object of the present invention to provide a method and an apparatus for efficiently and economically removing a film coating material from a photosensitive film support without the above-itemized conventional drawbacks.

Another object of the present invention is to provide a method and an apparatus, in which the steps of removal, washing and recovery are accomplished in a continuous manner.

According to the present invention, the film removing method comprises the following steps:

1. film chips, which are cut to have the chip shape, are continuously fed to the contacting zone;

2. a layer-removing liquid is continuously fed to the contacting zone;

3. in the contacting zone, the film chips and the removing liquid are continuously brought into contact with each other for layer removal;

4. after having been subjected to layer removal, the film chips are continuously extracted from the contacting zone;

5. after having been subjected to layer removal, a portion of the removing liquid is continuously withdrawn from the contacting zone, and discharged from the system and is replaced by a fresh removing liquid in the same amount as that discharged, so that the refreshed removing liquid may be recycled to the contacting zone in a circulating manner;

6. the film chips, which have been continuously extracted from the contacting zone, are fed to a washing zone;

7. washing water is continuously fed at a constant flow rate to the washing zone;

8. in the washing zone, the film chips and the washing water are counter currently contacted so that the former may be washed by the latter;

9. after washing, the film chips are continuously extracted from the washing zone;

10. the washing water, which adheres to the extracted film chips, is removed therefrom for recovery;

11. after the washing, the washing water is continuously discharged from the washing zone and is concentrated for recovery of the coating material; and 12. after the coating material has been recovered from the washing water, fresh water is fed to the washing water in an amount equal to the discharged portion thereof, and the resultant washing water thus refreshed is recycled the washing zone in a circulating manner.

In the above-itemized steps, it should be noted that the washing water is countercurrently contacted with the film chips, because otherwise, namely, if the contact should be accomplished in a parallel fashion, the efficiency obtainable in the washing operation is insufficient.

Moreover, although the layer-removing liquid composition may differ depending upon the kinds of film base or support employed and upon the kind of coating material, a protein decomposing enzyme will suffice if the photographic film used is composed of a film base coated with an emulsion in which the silver halide is suspended in a high molecular weight protein binder such as gelatin.

BRIEF DESCRIPTION OF THE ACCOMPANYING DRAWINGS

These and other objects and advantages of the present invention will be understood from the following description taken in conjunction with the accompanying drawings.

FIG. 2 is a detailed explanatory view showing a screw which is used in the embodiment of FIG. 1;

FIG. 3 is a detailed explanatory view showing an upper portion of a contacting column used in the embodiment of FIG. 1; and FIG. 4 is a graphical presentation showing the general relationship between the time lapse after initiation of the layer removal and the time period required for completion of the layer removal.

DESCRIPTION OF PREFERRED EMBODIMENTS

Figure 1:
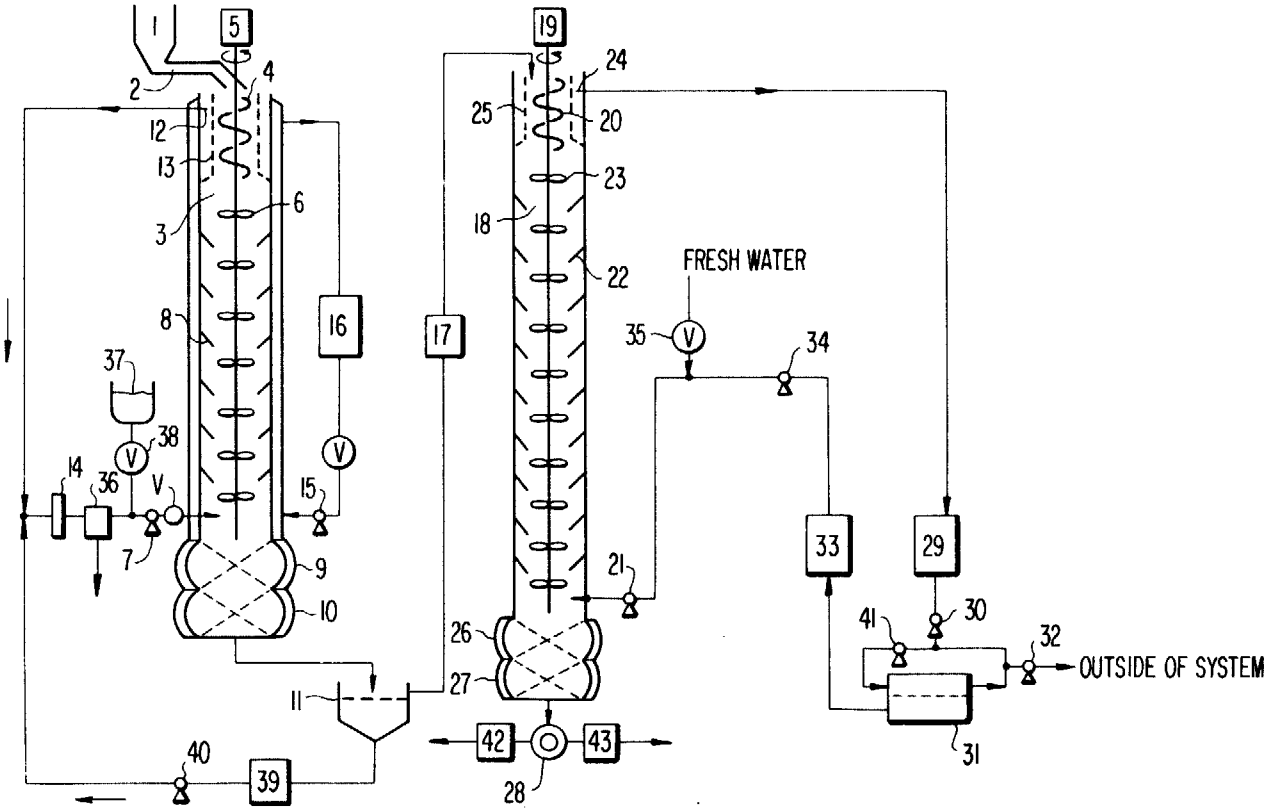
FIG. 1 is a flow sheet showing one embodiment of the film layer removing apparatus according to the present invention.

One embodiment of the film layer removing apparatus according to the present invention will now be described where the present invention is used for removing a film coating material from a photographic film.

FIG. 1 is a flow sheet showing one embodiment of the film layer removing apparatus according to the present invention.

In FIG. 1, film chips are continuously fed from a film chip reservoir 1 to an upper portion of a contacting column 3 by the action of an electromagnetic feeder 2. The feed speed of these film chips is determined based upon their residence time which corresponds to a predetermined contacting rate. In this instance, a screw 4 is mounted in the upper portion of the contacting column 3, as shown in FIG. 2, so that the film chips may be smoothly introduced into the contacting column 3. This screw 4 is rotated by a variable speed motor 5 so as to introduce the chips into the contacting column 3. In the middle portion of the contacting column 3, moreover, there are disposed stirring vanes 6 partly for allowing the film chips to smoothly sink in the contacting column 3 and partly for making sufficient contact of the chips with a layer-removing contacting liquid such as a liquid containing an enzyme. The stirring vanes 6, which are mounted on a common shaft together with the screw 4, are composed of a plurality of blades. The uppermost and lowermost blades are so designed to establish a downward flow of the removing liquid, whereas the intermediate blades are so designed to establish an upward flow.

The removing liquid, e.g., containing an enzyme, is, on the other hand, fed to the contacting column 3 through its lower portion by the action of a circulating pump 7. The feed speed of this liquid is also determined based on its residence time which corresponds to a predetermined contacting rate. The removing liquid thus fed from the lower portion of the contacting column 3 will then counter the falling film chips, which have been fed from the upper portion of the contacting column 3. As a result, the desired removal rate is initiated between the film chips and the counter flow of the removing liquid.

On the other hand, a plurality of baffle plates 8 are attached to the inner wall of the contacting column 3 in its middle portion where the stirring vanes 6 are positioned. These baffle plates 8 are inclined at a downward angle, so that the film chips, which will sink along the inner wall of the contacting column where the upward flow of the removing liquid is not very great, do not descend within a markedly shorter time period than a mean residence time of the film chips.

The film chips, which have been subjected to the layer removing reaction while descending, are then continuously extracted from the lower portion of the contacting column 3 through pinch valves 9 and 10. The opening of these pinch valves 9 and 10 is so regulated as to allow the extraction of the film chips while they restrict the flow-out of the removing liquid. Since both the removing liquid after completion of the removal and the coating material dissolved in the liquid (both of which will be referred to briefly as "the adhered liquid") still are adhered to the film chips thus extracted, the film chips are then transferred to a vibrating screen 11, in which the adhering liquid is separated from the chips by vibration. This separating operation can be said to be sufficient if most of the adhering liquid on the chips is removed, and as such this operation need not be perfect.

On the other hand, the removing liquid, which has been contacted with the film chips while it is rising in the contacting column 3, is continuously extracted to the outside of the column 3 through an overflowing process at an outlet 12. As can be better seen in FIGS. 2 and 3, this outlet 12 is defined by a concentric cylindrical wire netting 13, which is disposed in the contacting column 3 so as to prevent the outlet 12 from being clogged by the film chips flowing upward in the contacting liquid. In this instance, moreover, the rotation of the screw 4 is at a suitable spacing from the wire netting 13 so as to prevent the film chips from adhering to the wire netting 13. Here, it is probable that fine film chips which can pass through the wire netting 13 may also pass with the removing liquid which has been subjected to the contacting reaction and which is to be extracted from the contacting column 3 through the overflowing process. This passage of the fine chips could possibly disrupt the operation of the circulating pump 7 and the subsequent treatment of the removing liquid. Such being the case, the removing liquid passed through a filter 14, in which these fine filter chips are removed.

In order to be able to select any desired contacting temperature, the contacting column 3 has a double tube structure, within which warm water at an appropriate temperature is circulated using circulating pump 15. This circulating warm water is maintained at a constant temperature by passing through a constant temperature bath 16.

The residence time of the removing liquid is determined by two factors, that is, by the speed of rotation of the variable speed motor 5 and by the feed rate of the liquid due to the circulating pump 7. Thus, the residence time can be varied widely by suitably combining the above-recited two determining factors.

At the next stage, the film chips, from which most of the adhering liquid has been removed, is continuously fed to an upper portion of a washing column 18 by a screw conveyor 17.

Then, the chips thus continuously fed to the washing column 18 are conveyed smoothly into the washing column 18 by a screw 20, which is rotated by a variable speed motor 19. The chips thus conveyed are then contacted in the washing column 18 with the washing water which has been fed to a lower portion of the column 18 by a water supply pump 21. As a result, the chips can be washed by the counter-flow of the rising washing water. In order that the film chips do not sink along the inner wall of the washing column 18 within an excessively short time period and that they contact sufficiently the washing water, baffle plates 22 and stirring vanes 23 which are attached to a common shaft together with the screw 20 are mounted in the washing column 18. The construction and attaching manner of these baffle plates 22 and stirring vanes 23 are quite the same as those of the baffle plates 8 and the stirring vanes 6 in the contacting column 3.

The washing water, which has reached the upper portion of the washing column 18 while it is contacting with the film chips, is extracted from the column 18 through the overflowing process substantially in a similar manner to the case of the contacting column 3. An outlet 24 is also defined in the washing column 18 by a wire netting 25 in a similar manner as the case of the outlet 12 of the removing liquid for the contacting column 3.

The film chips, which have reached the lower portion of the washing column 18 while being contacting with the washing water, are then extracted from the column 18 through pinch valves 26 and 27 in a similar manner to the case of contacting column 3.

The film chips thus extracted continuously from the washing column 18 are then fed to a centrifugal hydroextractor 28, in which the separation of the film chips from the washing water is carried out. The film chips thus separated from the washing water are then continuously recovered using suitable means 42.

On the other hand, the washing water, which has been separated from the film chips, is also continuously removed by suitable means 43, such as a drain pipe. The washing water, which has been continuously extracted from the washing column 18, is, on the contrary, fed to a water reservoir 29.

The washing water thus fed to the reservoir 29 contains the dissolved coating material. In order to recover the content of the coating material, the washing water in the reservoir 29 is continuously extracted with a pump 30 and is fed to a circulating flow which is made by a circulating pump 41 to normally circulate and pass through an ultrafilter 31, in which the filtering and concentrating operations of the washing water are carried out. A portion of the washing water, which is concentrated in the ultrafilter 31, is continuously extracted from the system by a pump 32. On the other hand, the washing water, which has been subjected to the filtering operation to remove the coating material, is fed to a reservoir 33 for recycle to the washing column 18. Subsequently, the filtered washing water is continuously extracted from the reservoir 33 by a pump 34. Fresh water is supplied at a downstream portion of the pump 34 through a valve 35 in an amount to adjust and balance that portion of the washing water which has been discharged from the system. The washing water thus balanced is then fed back to the lower portion in a circulating fashion by water supply pump 21.

The removing liquid, which has been extracted from the upper outlet 12 of the contacting column 3 to the outside of the same through the overflowing process, will join or flow together with the adhering liquid which has been separated from the film chips by the vibrating screen 11 and which has been fed through the reservoir 39 by the pump 40. The resultant combined liquid is then passed through the filter 14, in which even the fine filter chips are removed therefrom. A portion of the removing liquid thus filtered is then extracted from the system through a by-pass conduit 36. To the remaining portion of the removing liquid, is supplied a removing liquid, for example, a liquid which contains a fresh enzyme, so as to maintain the overall reaction rate at a constant value. The introduction of the additional removing liquid is made from a fresh liquid reservoir 37 by the action of a pump 38. The removing liquid thus refreshed is then fed to the lower portion of the contacting column 3 by pump 7. The feed amount of the refreshed removing liquid containing the fresh liquid is such that it can compensate for or balance the removing liquid which is discharged from the system.

One reason why it is necessary to additionally supply fresh removing liquid is that if the liquid system involves an enzymatic reaction, since the activity of the enzyme is deteriorated progressively decreasing the removing rate after the liquid is brought into contact reaction with the film chips, the time period required for contacting has to be prolonged more and more so as to maintain the degree of the removal of the emulsion from the film chips at a constant level. Since the ability to vary the time period for the contacting is highly restricted due to the shape of the film chips themselves, it is found quite difficult to change the particular time period and thus a fresh removing liquid is additionally supplied.

This difficulty is not limited in the case using a contacting liquid containing an enzyme but is likewise experienced in general with removing liquids.

Turning now to FIG. 4, in which the general relationship is graphically shown between the time lapse *t* after initiation of the layer removal and the time period T required for completion of the layer removal.

As can be seen from FIG. 4, at the initial stage of contacting, the time period for completion of the removal is To. If, however, no fresh removing liquid is additionally supplied, that is, if the removing liquid, which is getting older and older, is just recirculated repeatedly, the removal ability of the liquid is deteriorated accordingly increasing the time period for completion of the removing reaction on and on. If, moreover, this condition should be continued, the removal ability of the liquid ultimately will become zero with an infinite time period for completion of the removal. Then, a removal would be impossible. This condition is understood from the broken curve of FIG. 4. If, however, a portion of the used removing liquid is extracted and replaced by a fresh removing liquid in an amount to balance the extracted portion after a time period *to* has elapsed from the initiation of the contacting, then it is quite possible to prevent the time period for completion of the reaction from increasing. If, moreover, the amount of the used removing liquid extracted and the amount of the fresh liquid additionally supplied are suitably experimentally selected as a function of the time lapse *t* after initiation of the reaction, then the required time period can be maintained at a constant value after the time lapse *to.* This probability is illustrated by the solid curve of FIG. 4.

The description of the present invention thus far made is restricted to one embodiment only, but it should be noted that the present invention itself should not be limited to such embodiment, and that the removing apparatus can be modified appropriately without departing from the spirit and concept of the present invention. For instance, the electromagnetic feeder 2 can be replaced by a screw conveyor. A centrifugal hydroextractor can also be used in place of the vibrating screen 11. The concentrating operation of the washing water need not be necessarily employ ultrafilter 31 and an inverse osmosis means can be used. In order to suppress the concentration of silver halide in the contacting column 3 and accordingly to restrain the deterioration in activity of the enzyme where such is used, moreover, by-pass conduit 36 may be replaced by a liquid cyclone so as to reduce the concentration of silver halide in the circulating removing liquid. In addition, it is absolutely unnecessary to discharge the washing water, which has been removed from the film chips by the action of the centrifugal hydroextractor from the system, and as such the particular washing water may be supplied to the circulating system of the washing water using suitable means, if desired. This modification can be said to be quite practical because the water consumption can be reduced to a lower level. The contact between the film chips and the removing liquid in the contacting column 3 could be changed from a countercurrent contact to a parallel contact, if a reduction in the resultant efficiency is acceptable for some purposes. The foregoing description has been directed exclusively to the case in which photographic film is used, but it goes without saying that the present invention can be applied to films in general which are coated with a coating material.

The invention is illustrated further by reference to the following example, in which all parts and percents are by weight unless otherwise indicated.

EXAMPLE

Removal of the film coating material was accomplished for a photographic film, which contained 10 g of silver bromide, 5 g of dry gelatin and 200 g of film base per 1 $m^2$, under the following experimental conditions:

| | |
|---|---|
| Diameter of Reaction Column | 100 mm |
| Length of Reaction Column | 1,500 mm |
| Rate of Rotation of Screw and Stirring Vanes | 300 r.p.m. |
| Operating Temperature | 60° C |
| Size of Film Chips | Square with Side of 1 cm |
| Feed Amount of Film Chips | 5 kg/hr. |

The removing liquid contained 0.05% of a protein decomposing enzyme at the initial stage of the removal, and the amount of circulation of the removing liquid was 400 l/hr. After 30 minutes had elapsed from the initiation of the reaction, the extraction of the removing liquid from the circulating system was initiated at the flow rate of 5 l/hr, with a supplementing of the fresh removing liquid containing 0.05% of the protein decomposing enzyme being concurrently initiated at a flow rate of 5 l/hr.

The film chips, which had been subjected to the removing reaction in this way, were then fed to the washing column for the subsequent washing operation, under the following experimental conditions:

| | |
|---|---|
| Diameter of Washing Column | 100 mm |
| Length of Washing Column | 1,500 mm |
| Rate of Rotation of Screw and Stirring Vanes | 300 r.p.m. |
| Operating Temperature | about 25° C |
| Feed Amount of Film Chips | 5 kg/hr. |

City water was used as the washing water, and the amount of the washing water was 50 l/hr. To supplement the water removed from the circulating system, fresh water was additionally supplied to the circulating system at 2.5 l/hr.

It was confirmed that the coating material adhered to the film chips was completely removed therefrom after the washing process had been finished.

The washing water, which was discharged from the washing column, was then fed to the ultrafilter at a rate of 50 l/hr. The concentration of the coating material in this discharged washing water was 1,700 ppm. In the ultrafilter, the concentration of the washing water was carried out with the concentrated washing water in an amount of 6.5 l/hr and with the recovered washing water in an amount of 43.5 l/hr at an operating temperature of 43° to 40° C. Then, the concentration of the coating material in the concentrated washing water was 13,000 ppm, and the concentration of the coating material in the recovered washing water was far below the allowable level.

According to the present invention, the features which can be obtained are as follows.

1. Since the present method is a continuous process which is different from the conventional batch process method, improvement in working efficiency and a labor saving operation can be obtained, thus leading to a substantial reduction in the cost.

2. The removing reaction can be accomplished under substantially constant operating condition.

3. Since the effective amount of the removing liquid can be increased for the film chips by circulating the removing liquid, the undesired failure of the lack of removal of the coating material can be substantially obviated, which might otherwise come from the adherence between the chip surfaces.

4. Since the removing liquid is circulated for repeated use, a substantial reduction in the amount of the liquid can result. When a liquid containing an enzyme is used as the removing liquid, the consumption of the enzyme is reduced to about half or a quarter of that required in the conventional batch process method.

5. Since the waste washing liquid is circulated for repeated use, both the treatment itself of the waste and the equipment for waste treatment can be remarkably simplified, and the consumption of the washing water can be remarkably reduced.

6. Since the present method is continuous, the system can be made smaller than that required in the conventional method even for a large capacity.

7. Since, when the present method is used in recovery of silver in photographic film, a liquid having a low concentration of silver, such as the washing water, is concentrated in the method, the separation and recovery of silver can be carried out with ease by resorting to a settling method or the like.

While the invention has been described in detail and with reference to specific embodiments thereof, it will be apparent to one skilled in the art that various changes and modifications can be made therein without departing from the spirit and scope thereof.

What is claimed is:

1. An apparatus for continuously removing a coating material on film chips comprising:

a. contacting means of a generally cylindrical shape for containing a removing liquid and including a rotatable shaft, said shaft having at least one screw and a plurality of stirring vanes, and said contacting means having a plurality of baffle plates attached to the inner wall of said contacting means and angled downwardly to urge film chips down said contacting means;

b. means for feeding film chips to an upper portion of said contacting means;

c. means for discharging said film chips from a lower portion of said contacting means;

d. means for feeding a removing liquid to said contacting means at a lower portion thereof;

e. means for withdrawing the removing liquid from said contacting means at an upper portion thereof;

f. means for discharging a portion of the removing liquid to outside said apparatus;

g. means for supplying a fresh removing liquid to the remaining withdrawn removing liquid;

h. means for separating removing liquid from said discharged film chips; and i. means coupled to the means of (e), (g) and (h) for feeding the removing liquid containing the fresh removing liquid to the feeding means of (d).

2. A system for continuously removing a coating material on a film support comprising:

a. contacting means of a generally cylindrical shape for containing a removing liquid and including a rotatable shaft, said shaft having at least one screw and a plurality of stirring vanes, and said contacting means having a plurality of baffle plates attached to the inner wall of said contacting means and angled downwardly;

b. means for feeding film chips to an upper portion of said contacting means;

c. means for discharging said film chips from a lower portion of said contacting means;

d. means for feeding a removing liquid to said contacting means;

e. means for withdrawing the removing liquid from said contacting means;

f. means for discharging a portion of the removing liquid to outside said system;

g. means for supplying a fresh removing liquid to the remaining withdrawn removing liquid;

h. means for feeding the removing liquid containing the fresh removing liquid to the feeding means of (d);

i. washing means of a generally cylindrical shape including a rotatable shaft therein, said shaft having at least one screw and a plurality of stirring vanes, and said washing means having a plurality of baffle plates attached to the inner wall of said washing means and angled downwardly;

j. means for continuously feeding the film chips, which have been extracted from said contacting means, to an upper portion of said washing means;

k. means for feeding washing water to a lower portion of said washing means;

l. means for withdrawing the film chips from a lower portion of said washing means and for feeding the same to a hydroextracting means;

m. means for extracting the film chips from said hydroextracting means to outside said apparatus;

n. means for withdrawing the washing water from an upper portion of said washing means;

o. means for feeding the washing water, which has been withdrawn from said washing means to a washing water concentrating means;

p. means for discharging the washing water, which has been concentrated by said washing water concentrating means, to the outside;

q. means for withdrawing the remaining washing water from said washing water concentrating means;

r. means for supplying fresh washing water to the remaining concentrated washing water; and s. means for feeding the washing water replenished with fresh washing water to the feeding means of (k).

* * * * *